US011620980B2

(12) United States Patent
Chen et al.

(10) Patent No.: US 11,620,980 B2
(45) Date of Patent: Apr. 4, 2023

(54) TEXT-BASED SPEECH SYNTHESIS METHOD, COMPUTER DEVICE, AND NON-TRANSITORY COMPUTER-READABLE STORAGE MEDIUM

(71) Applicant: Ping An Technology (Shenzhen) Co., Ltd., Guangdong (CN)

(72) Inventors: Minchuan Chen, Guangdong (CN); Jun Ma, Guangdong (CN); Shaojun Wang, Guangdong (CN)

(73) Assignee: Ping An Technology (Shenzhen) Co., Ltd., Guangdong (CN)

( * ) Notice: Subject to any disclaimer, the term of this patent is extended or adjusted under 35 U.S.C. 154(b) by 169 days.

(21) Appl. No.: 17/178,823

(22) Filed: Feb. 18, 2021

(65) Prior Publication Data

US 2021/0174781 A1 Jun. 10, 2021

Related U.S. Application Data

(63) Continuation of application No. PCT/CN2019/117775, filed on Nov. 13, 2019.

(30) Foreign Application Priority Data

Jan. 17, 2019 (CN) ..... 201910042827.1

(51) Int. Cl.
*G10L 13/08* (2013.01)
*G10L 13/047* (2013.01)
(Continued)

(52) U.S. Cl.
CPC ..... *G10L 13/08* (2013.01); *G10L 13/047* (2013.01); *G10L 25/18* (2013.01); *G10L 25/24* (2013.01)

(58) Field of Classification Search
CPC ..... G10L 13/08; G10L 13/047; G10L 25/18; G10L 25/24; G10L 13/02
See application file for complete search history.

(56) References Cited

U.S. PATENT DOCUMENTS 11,568,245 B2 * 1/2023 Chang ..... G06N 3/04
2005/0119891 A1 6/2005 Chu et al.
(Continued)

FOREIGN PATENT DOCUMENTS

CN 105654939 A 6/2016
CN 107564511 A 1/2018
(Continued)

OTHER PUBLICATIONS

CNIPA, International Search Report for International Patent Application No. PCT/CN2019/117775, dated Jan. 23, 2020, 2 pages.

*Primary Examiner* — Fariba Sirjani
(74) *Attorney, Agent, or Firm* — IP Spring

(57) ABSTRACT

A text-based speech synthesis method, a computer device, and a non-transitory computer-readable storage medium are provided. The text-based speech synthesis method includes: a target text to be recognized is obtained; each character in the target text is discretely characterized to generate a feature vector corresponding to each character; the feature vector is input into a pre-trained spectrum conversion model, to obtain a Mel-spectrum corresponding to each character in the target text output by the spectrum conversion model; and the Mel-spectrum is converted to speech to obtain speech corresponding to the target text.

12 Claims, 2 Drawing Sheets

(51) Int. Cl.
*G10L 25/18* (2013.01)
*G10L 25/24* (2013.01)

(56) References Cited

U.S. PATENT DOCUMENTS

| | | | | |
|---|---|---|---|---|
| 2017/0345411 | A1* | 11/2017 | Raitio | G10L 13/06 |
| 2018/0330729 | A1* | 11/2018 | Golipour | G10L 15/26 |
| 2018/0336880 | A1* | 11/2018 | Arik | G10L 15/063 |
| 2019/0333521 | A1* | 10/2019 | Khoury | G10L 17/20 |
| 2020/0051583 | A1* | 2/2020 | Wu | G06N 3/0445 |
| 2020/0066253 | A1* | 2/2020 | Peng | G10L 25/30 |
| 2020/0082807 | A1* | 3/2020 | Kim | G10L 13/0335 |
| 2021/0020161 | A1* | 1/2021 | Gao | G10L 13/08 |
| 2021/0158789 | A1* | 5/2021 | Wu | G06F 40/35 |
| 2021/0174781 | A1* | 6/2021 | Chen | G10L 13/047 |

FOREIGN PATENT DOCUMENTS

| | | | |
|---|---|---|---|
| CN | 108492818 | A | 9/2018 |
| CN | 109036375 | A | 12/2018 |
| CN | 109754778 | A | 5/2019 |

* cited by examiner

TEXT-BASED SPEECH SYNTHESIS METHOD, COMPUTER DEVICE, AND NON-TRANSITORY COMPUTER-READABLE STORAGE MEDIUM

CROSS-REFERENCE TO RELATED APPLICATIONS

This application is a continuation under 35 U.S.C. § 120 of PCT Application No. PCT/CN2019/117775 filed on Nov. 13, 2019, which claims priority under 35 U.S.C. § 119(a) and/or PCT Article 8 to Chinese Patent Application No. 201910042827.1 filed on Jan. 17, 2019, the disclosures of which are hereby incorporated by reference in their entireties.

TECHNICAL FIELD

The application relates to the technical field of artificial intelligence, in particular to a text-based speech synthesis method, a computer device, and a non-transitory computer-readable storage medium.

BACKGROUND

Manually producing speech through a machine is called speech synthesis. Speech synthesis is an important part of man-machine speech communication. Speech synthesis technology may be used to make machines speak like human beings, so that some information that are represented or stored in other ways can be converted into speech, and then people may easily get the information by hearing.

In a related art, in order to solve the problem of pronunciation of multi-tone characters in speech synthesis technology, a method based on rules or a method based on statistical machine learning is mostly adopted. However, the method based on rules requires a large number of rules to be set manually, and the method based on statistical machine learning is easily limited by uneven distribution of samples. Moreover, both the method based on rules and the method based on statistical machine learning require a lot of phonetic annotations on training text, which undoubtedly greatly increases the workload.

SUMMARY

A text-based speech synthesis method, a computer device, and a non-transitory computer-readable storage medium are provided.

In a first aspect, the embodiments of the application provide a text-based speech synthesis method, which includes the following: obtaining a target text to be recognized; discretely characterizing each character in the target text to generate a feature vector corresponding to each character; inputting the feature vector into a pre-trained spectrum conversion model to obtain a Mel-spectrum corresponding to each character in the target text output by the spectrum conversion model; and converting the Mel-spectrum into speech to obtain speech corresponding to the target text.

In a second aspect, a computer device is provided. The computer device includes a memory, a processor, and a computer program which is stored on the memory and capable of running on the processor. The computer program, when executed by the processor, causes the processor to implement: obtaining a target text to be recognized; discretely characterizing each character in the target text to generate a feature vector corresponding to each character; inputting the feature vector into a pre-trained spectrum conversion model to obtain a Mel-spectrum corresponding to each character in the target text output by the spectrum conversion model; and converting the Mel-spectrum into speech to obtain speech corresponding to the target text.

In a third aspect, the embodiments of the application further provide a non-transitory computer-readable storage medium, which stores a computer program. The computer program, when executed by the processor, causes the processor to implement: obtaining a target text to be recognized; discretely characterizing each character in the target text to generate a feature vector corresponding to each character; inputting the feature vector into a pre-trained spectrum conversion model to obtain a Mel-spectrum corresponding to each character in the target text output by the spectrum conversion model; and converting the Mel-spectrum into speech to obtain speech corresponding to the target text.

BRIEF DESCRIPTION OF THE DRAWINGS

In order to more clearly illustrate the technical solution in the embodiments of the application, the accompanying drawings needed in description of the embodiments are simply introduced below. It is apparent, for those of ordinary skill in the art, that the accompanying drawings in the following description are some embodiments of the application, and some other accompanying drawings can also be obtained according to these on the premise of not contributing creative effort.

DETAILED DESCRIPTION OF THE EMBODIMENTS

In order to better understand the technical solution of the application, the embodiments of the application are described in detail below in combination with the accompanying drawings.

It should be clear that the described embodiments are only part, rather than all, of the embodiments of the application. All other embodiments obtained by those of ordinary skill in the art based on the embodiments in the application without creative work shall fall within the scope of protection of the application.

Terms used in the embodiments of the application are for the purpose of describing particular embodiments only and are not intended to limit the application. Singular forms "a", "an" and "the" used in the embodiments of the application and the appended claims of the present disclosure are also intended to include the plural forms unless the context clearly indicates otherwise.

Figure 1:
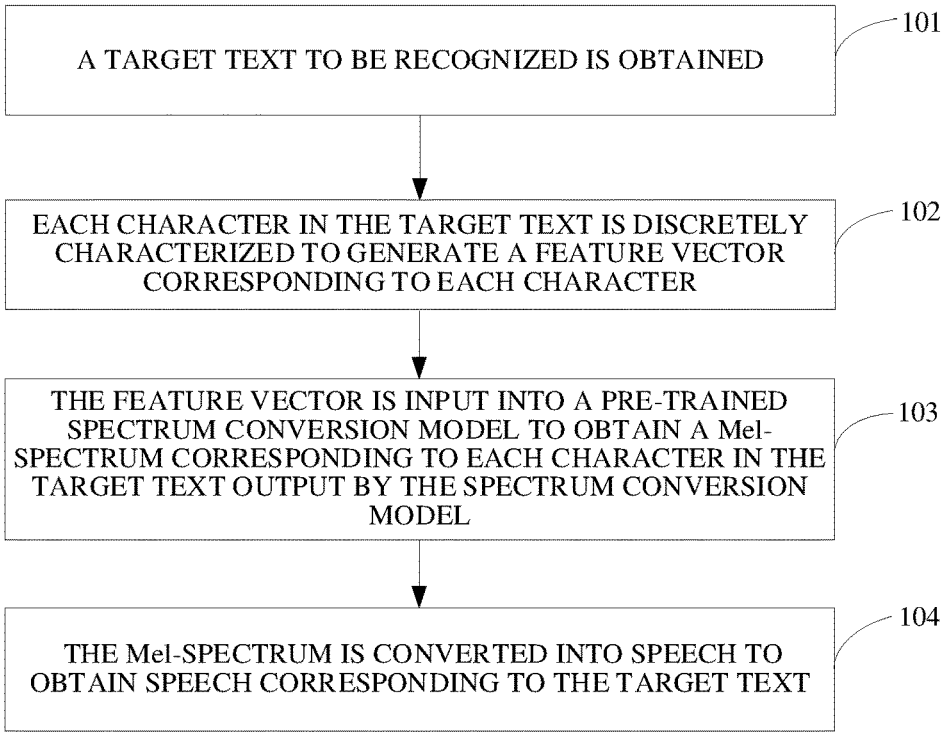
FIG. 1 is a flowchart of an embodiment of a text-based speech synthesis method according to the application.

FIG. 1 is a flowchart of an embodiment of a text-based speech synthesis method according to the application. As shown in FIG. 1, the method may include the following steps.

At S101, a target text to be recognized is obtained.

Specifically, the text to be recognized may be obtained through an obtaining module. The obtaining module may be any input method with written language expression function. The target text refers to any piece of text with written language expression form.

At S102, each character in the target text is discretely characterized to generate a feature vector corresponding to each character.

Further, the discrete characterization is mainly used to transform a continuous numerical attribute into a discrete numerical attribute. In the application, the application uses One-Hot coding for the discrete characterization of the target text.

Specifically, how the application uses the One-Hot coding to obtain the feature vector corresponding to each character in the target text is described below.

First, it is assumed that the application has the following preset keywords, and each keyword is numbered as follows:

1 for teacher, 2 for like, 3 for learning, 4 for take classes, 5 for very, 6 for humor, 7 for I, and 8 for profound.

Secondly, when the target text in the application is "teacher has very profound learning", the target text is first separated to match the above preset keywords, that is, the target text is separated into "teacher", "learning", "very" and "profound".

Then, by matching "teacher", "learning", "very" and "profound" with the numbers of the preset keywords, the following table is obtained:

| 1 teacher | 2 like | 3 learning | 4 take classes | 5 very | 6 humor | 7 I | 8 profound |
|---|---|---|---|---|---|---|---|
| 1 | 0 | 1 | 0 | 1 | 0 | 0 | 1 |

Therefore, for the target text "teacher has very profound learning", the feature vector corresponding to each character in the target text can finally be obtained as 10101001.

The above preset keywords and the numbers of the preset keywords may be set by users themselves according to the implementation requirements. The above preset keywords and the corresponding numbers of the preset keywords are not qualified in the embodiment. The above preset keywords and the numbers of the preset keywords are examples for convenience of understanding.

At S103, the feature vector is input into a pre-trained spectrum conversion model to obtain a Mel-spectrum corresponding to each character in the target text output by the spectrum conversion model.

In specific implementation, the spectrum conversion model may be a sequence conversion model (Sequence to Sequence, hereinafter referred to as seq2seq). Furthermore, the application outputs the Mel-spectrum corresponding to each character in the target text through the seq2seq model. Because the seq2seq model is a very important and popular model in natural language processing technology, it has a good performance. By using the Mel-spectrum as the expression of sound feature, the application may make it easier for the human ear to perceive changes in sound frequency.

Specifically, the unit of sound frequency is Hertz, and the range of frequencies that the human ear can hear is 20 to 20,000 Hz. However, there is not a linear perceptive relationship between the human ear and Hertz as a scale unit. For example, we adapt to the tone of 1000 Hz, and if the frequency of the tone is increased to 2000 Hz, our ear can only notice a slight increase in frequency, not a doubling of frequency at all. While the perception of frequency of the human ear becomes linear through the representation of the Mel-spectrum That is, if there is a twofold difference in the Mel-spectrum between the two ends of speech, the human ear is likely to perceive a twofold difference in the tone.

At S104, the Mel-spectrum is converted into speech to obtain speech corresponding to the target text.

Furthermore, the Mel-spectrum may be converted into speech for output by connecting a vocoder outside the spectrum conversion model.

In practical applications, the vocoder may convert the above Mel-spectrum into a speech waveform signal in the time domain by the inverse Fourier transform. Because the time domain is the real world and the only domain that actually exists, the application may obtain the speech more visually and intuitively. In the above speech synthesis method, after the target text to be recognized is obtained, each character in the target text is discretely characterized to generate the feature vector corresponding to each character, the feature vector is input into the pre-trained spectrum conversion model to obtain the Mel-spectrum corresponding to each character in the target text output by the spectrum conversion model, and the Mel-spectrum is converted into speech to obtain speech corresponding to the target text. In this way, during speech synthesis, there is no need to mark every character in the text in pinyin, which effectively reduces the workload in the speech synthesis process and provides an effective solution for the pronunciation problem in the speech synthesis process.

Figure 2:
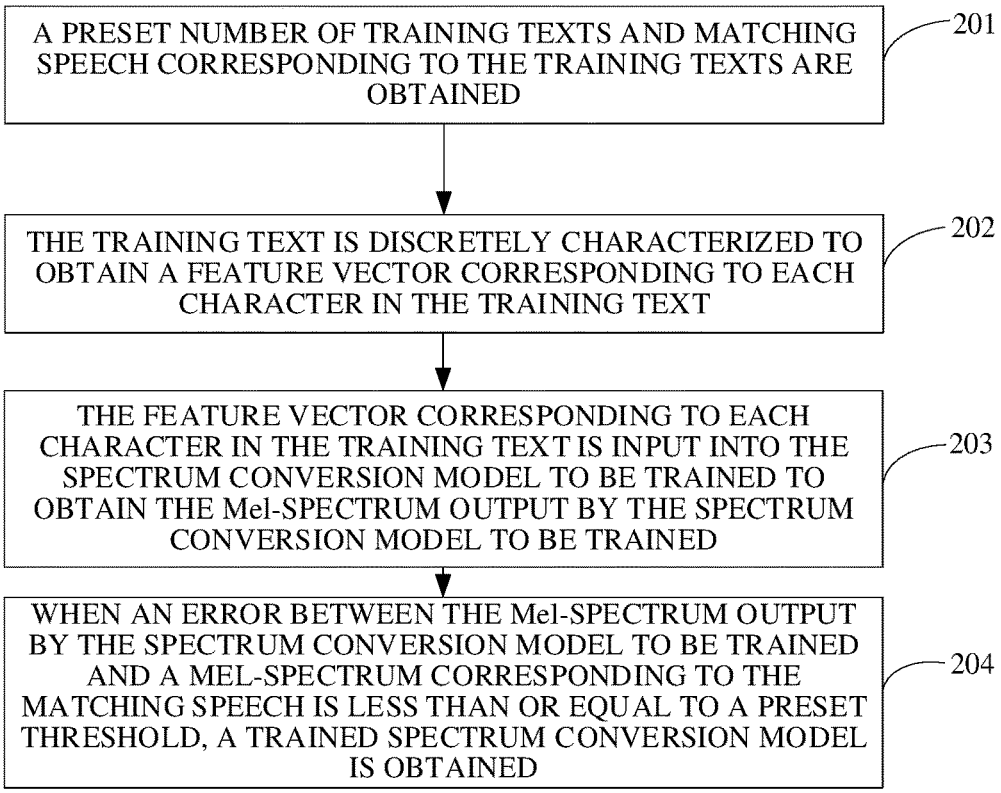
FIG. 2 is a flowchart of another embodiment of a text-based speech synthesis method according to the application.

FIG. 2 is a flowchart of another embodiment of a text-based speech synthesis method according to the application. As shown in FIG. 2, in the embodiment shown in FIG. 1, before S103, the method may further include the following steps.

At S201, a preset number of training texts and matching speech corresponding to the training texts are obtained.

Specifically, similar to the concept of the target text, the training text in the embodiment also refers to any piece of text with written language representation.

The preset number may be set in specific implementation by the users themselves according to system performance and/or implementation requirements. The embodiment does not limit the preset number. For example, the preset number may be 1000.

At S202, the training text is discretely characterized to obtain a feature vector corresponding to each character in the training text.

Similarly, in the embodiment, the One-Hot coding may be used to perform the discrete characterization of the training text. For the detailed implementation process, the relevant description in S102 may be referred to, so it will not be repeated here.

At S203, the feature vector corresponding to each character in the training text is input into the spectrum conversion model to be trained to obtain the Mel-spectrum output by the spectrum conversion model to be trained.

Furthermore, S203 may include the following steps.

At step (1), the training text is coded through the spectrum conversion model to be trained to obtain a hidden state sequence corresponding to the training text, the hidden state sequence including at least two hidden nodes.

The hidden state sequence is obtained by mapping the feature vectors of each character in the training text one by one. The number of characters in the training text corresponds to the number of hidden nodes.

At step (2), the hidden node is weighted according to a weight of the hidden node corresponding to each character to obtain a semantic vector corresponding to each character in the training text.

Specifically, the corresponding semantic vector may be obtained by adopting the formula (1) of attention mechanism:

$$C_i = \sum_{j=1}^{N} a_{ij} h_j, \tag{1}$$

where $C_i$ represents the i-th semantic vector, N represents the number of hidden nodes, and $h_j$ represents the hidden node of the j-th character in coding. The attention mechanism refers to that $a_{i,j}$ represents the correlation between the j-th phase in coding and the i-th phase in decoding, so the most appropriate context information for the current output is selected for each semantic vector.

At step (3), the semantic vector corresponding to each character is decoded, and the Mel-spectrum corresponding to each character is output.

At S204, when an error between the Mel-spectrum output by the spectrum conversion model to be trained and a Mel-spectrum corresponding to the matching speech is less than or equal to a preset threshold, a trained spectrum conversion model is obtained.

Further, when the error between the Mel-spectrum output by the spectrum conversion model to be trained and the Mel-spectrum corresponding to the matching speech is greater than the preset threshold, the method further includes the following operation.

For the weight of each hidden node, error information is back propagated for updating and iterated continuously until the error between the Mel-spectrum output by the spectrum conversion model to be trained and the Mel-spectrum corresponding to the matching speech is less than or equal to the preset threshold.

Specifically, after the weight of the hidden node is updated, first it is needed to weight the hidden node whose weight is updated to obtain a semantic vector corresponding to each character in the training text, then the semantic vector corresponding to each character is decoded, and the Mel-spectrum corresponding to each character is output, and finally, when the error between the Mel-spectrum corresponding to each character and the Mel-spectrum corresponding to the matching speech is less than or equal to the preset threshold, the process of updating the weight of each hidden node is stopped, and the trained spectrum conversion mode is obtained.

The preset threshold may be set in specific implementation by the users themselves according to system performance and/or implementation requirements. The embodiment does not limit the preset threshold. For example, the preset threshold may be 80%.

Figure 3:
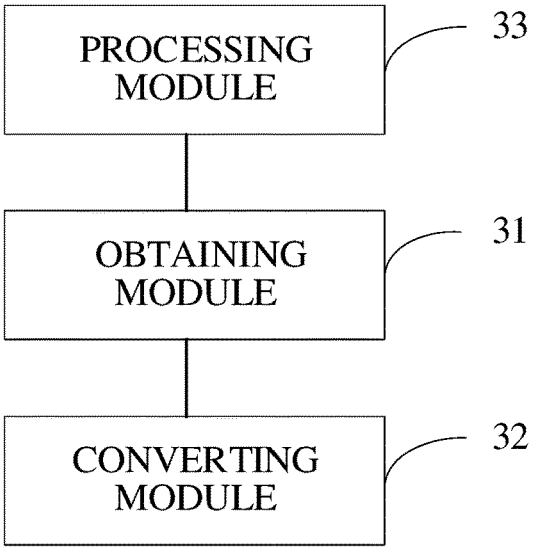
FIG. 3 is a schematic diagram illustrating a connection structure of an embodiment of a text-based speech synthesis device according to the application.

FIG. 3 is a schematic diagram illustrating a connection structure of an embodiment of a text-based speech synthesis device according to the application. As shown in FIG. 3, the device includes an obtaining module 31 and a converting module 32.

The obtaining module 31 is configured to obtain the target text to be recognized and the feature vector corresponding to each character in the target text that is discretely characterized by a processing module 33, and input the feature vector corresponding to each character in the target text into the pre-trained spectrum conversion model to obtain the Mel-spectrum corresponding to each character in the target text output by the spectrum conversion model.

Specifically, the target text to be recognized may be obtained through any input method with written language expression function. The target text refers to any piece of text with written language expression form.

In specific implementation, the spectrum conversion model may be the seq2seq model. Furthermore, the application outputs the Mel-spectrum corresponding to each character in the target text through the seq2seq model. Because the seq2seq model is a very important and popular model in natural language processing technology, it has a good performance By using the Mel-spectrum as the expression of sound feature, the application may make it easier for the human ear to perceive changes in sound frequency.

Specifically, the unit of sound frequency is Hertz, and the range of frequencies that the human ear can hear is 20 to 20,000 Hz. However, there is not a linear perceptive relationship between the human ear and Hertz as a scale unit. For example, we adapt to the tone of 1000 Hz, and if the frequency of the tone is increased to 2000 Hz, our ear can only notice a slight increase in frequency, not a doubling of frequency at all. While the perception of frequency of the human ear becomes linear through the representation of the Mel-spectrum That is, if there is a twofold difference in the Mel-spectrum between the two ends of speech, the human ear is likely to perceive a twofold difference in the tone.

Furthermore, the application uses the One-Hot coding for the discrete characterization of the target text. Then, the feature vector is input into the pre-trained spectrum conversion model to finally obtain the Mel-spectrum corresponding to each character in the target text output by the spectrum conversion model.

Furthermore, how the application uses the One-Hot coding to obtain the feature vector corresponding to each character in the target text is described below.

First, it is assumed that the application has the following preset keywords, and each keyword is numbered as follows:

1 for teacher, 2 for like, 3 for learning, 4 for take classes, 5 for very, 6 for humor, 7 for I, and 8 for profound.

Secondly, when the target text in the application is "teacher has very profound learning", the target text is first separated to match the above preset keywords, that is, the target text is separated into "teacher", "learning", "very" and "profound".

Then, by matching "teacher", "learning", "very" and "profound" with the numbers of the preset keywords, the following table is obtained:

| 1 teacher | 2 like | 3 learning | 4 take classes | 5 very | 6 humor | 7 I | 8 profound |
|---|---|---|---|---|---|---|---|
| 1 | 0 | 1 | 0 | 1 | 0 | 0 | 1 |

Therefore, for the target text "teacher has very profound learning", the feature vector corresponding to each character in the target text can finally be obtained as 10101001.

The above preset keywords and the numbers of the preset keywords may be set by users themselves according to the implementation requirements. The above preset keywords and the corresponding numbers of the preset keywords are not qualified in the embodiment. The above preset keywords and the numbers of the preset keywords are an example for the convenience of understanding.

The converting module 32 is configured to convert the Mel-spectrum obtained by the obtaining module 31 into speech to obtain speech corresponding to the target text.

Furthermore, the converting module 32 may be a vocoder. During transformation processing, the vocoder may convert the above Mel-spectrum into the speech waveform signal in the time domain by the inverse Fourier transform. Because the time domain is the real world and the only domain that actually exists, the application may obtain the speech more visually and intuitively.

In the above speech synthesis device, after the obtaining module 31 obtains the target text to be recognized, each character in the target text is discretely characterized through the processing module 33 to generate the feature vector corresponding to each character, and the feature vector is input into the pre-trained spectrum conversion model to obtain the Mel-spectrum corresponding to each character in the target text output by the spectrum conversion model, and the Mel-spectrum is converted into speech through the converting module 32 to obtain the speech corresponding to the target text. In this way, during speech synthesis, there is no need to mark every character in the text in pinyin, which effectively reduces the workload in the speech synthesis process and provides an effective solution for the pronunciation problem in the speech synthesis process.

With reference to FIG. 3, in another embodiment:

the obtaining module 31 is further configured to, before inputting the feature vector into the pre-trained spectrum conversion model to obtain the Mel-spectrum corresponding to each character in the target text output by the spectrum conversion model, obtain a preset number of training texts and matching speech corresponding to the training texts, obtain the feature vector corresponding to each character in the training text that is discretely characterized through the processing module 33, input the feature vector corresponding to each character in the training text into a spectrum conversion model to be trained to obtain a Mel-spectrum output by the spectrum conversion model to be trained, and when an error between a Mel-spectrum output by the spectrum conversion model to be trained and the Mel-spectrum corresponding to the matching speech is less than or equal to a preset threshold, obtain a trained spectrum conversion model.

Specifically, similar to the concept of the target text, the training text in the embodiment also refers to any piece of text with written language representation.

The preset number may be set in specific implementation by the users themselves according to system performance and/or implementation requirements. The embodiment does not limit the preset number. For example, the preset number may be 1000.

Similarly, in the embodiment, in the specific implementation of discretely characterizing the training text through the processing module 33 to obtain a feature vector corresponding to each character in the training text, the training text may be discretely characterized by the One-Hot coding. For the detailed implementation process, the relevant description of the embodiment in FIG. 3 may be referred to, so it will not be repeated here.

Furthermore, that the obtaining module 31 obtains the Mel-spectrum corresponding to the preset number of matching speech may include the following steps.

At step (1), the training text is coded through the spectrum conversion model to be trained to obtain a hidden state sequence corresponding to the training text, the hidden state sequence including at least two hidden nodes.

The hidden state sequence is obtained by mapping the feature vectors of each character in the training text one by one. The number of characters in the training text corresponds to the number of hidden nodes.

At step (2), the hidden node is weighted according to a weight of the hidden node corresponding to each character to obtain a semantic vector corresponding to each character in the training text.

Specifically, the corresponding semantic vector may be obtained by adopting the formula (1) of attention mechanism:

$$C_i = \sum_{j=1}^{N} a_{ij} h_j, \tag{1}$$

where $C_i$ represents the i-th semantic vector, N represents the number of hidden nodes, and $h_j$ represents the hidden node of the j-th character in coding. The attention mechanism refers to that $a_{i,j}$ represents the correlation between the j-th phase in coding and the i-th phase in decoding, so the most appropriate context information for the current output is selected for each semantic vector.

At step (3), the semantic vector corresponding to each character is decoded, and the Mel-spectrum corresponding to each character is output.

The obtaining module 31 is specifically configured to code the training text through the spectrum conversion model to be trained to obtain the hidden state sequence corresponding to the training text, the hidden state sequence including at least two hidden nodes, weight the hidden node according to the weight of the hidden node corresponding to each character to obtain the semantic vector corresponding to each character in the training text, and decode the semantic vector corresponding to each character and output the Mel-spectrum corresponding to each character.

Further, when the error between the Mel-spectrum output by the spectrum conversion model to be trained and the Mel-spectrum corresponding to the matching speech is greater than the preset threshold, the method further includes the following operation.

For the weight of each hidden node, error information is back propagated for updating and iterated continuously until the error between the Mel-spectrum output by the spectrum conversion model to be trained and the Mel-spectrum corresponding to the matching speech is less than or equal to the preset threshold.

Specifically, after the weight of the hidden node is updated, first it is needed to weight the hidden node whose weight is updated to obtain a semantic vector corresponding to each character in the training text, then the semantic vector corresponding to each character is decoded, and the Mel-spectrum corresponding to each character is output, and finally, when the error between the Mel-spectrum corresponding to each character and the Mel-spectrum corresponding to the matching speech is less than or equal to the preset threshold, the process of updating the weight of each hidden node is stopped, and the trained spectrum conversion mode is obtained.

The preset threshold may be set in specific implementation by the users themselves according to system performance and/or implementation requirements. The embodiment does not limit the preset threshold. For example, the preset threshold may be 80%.

Figure 4:
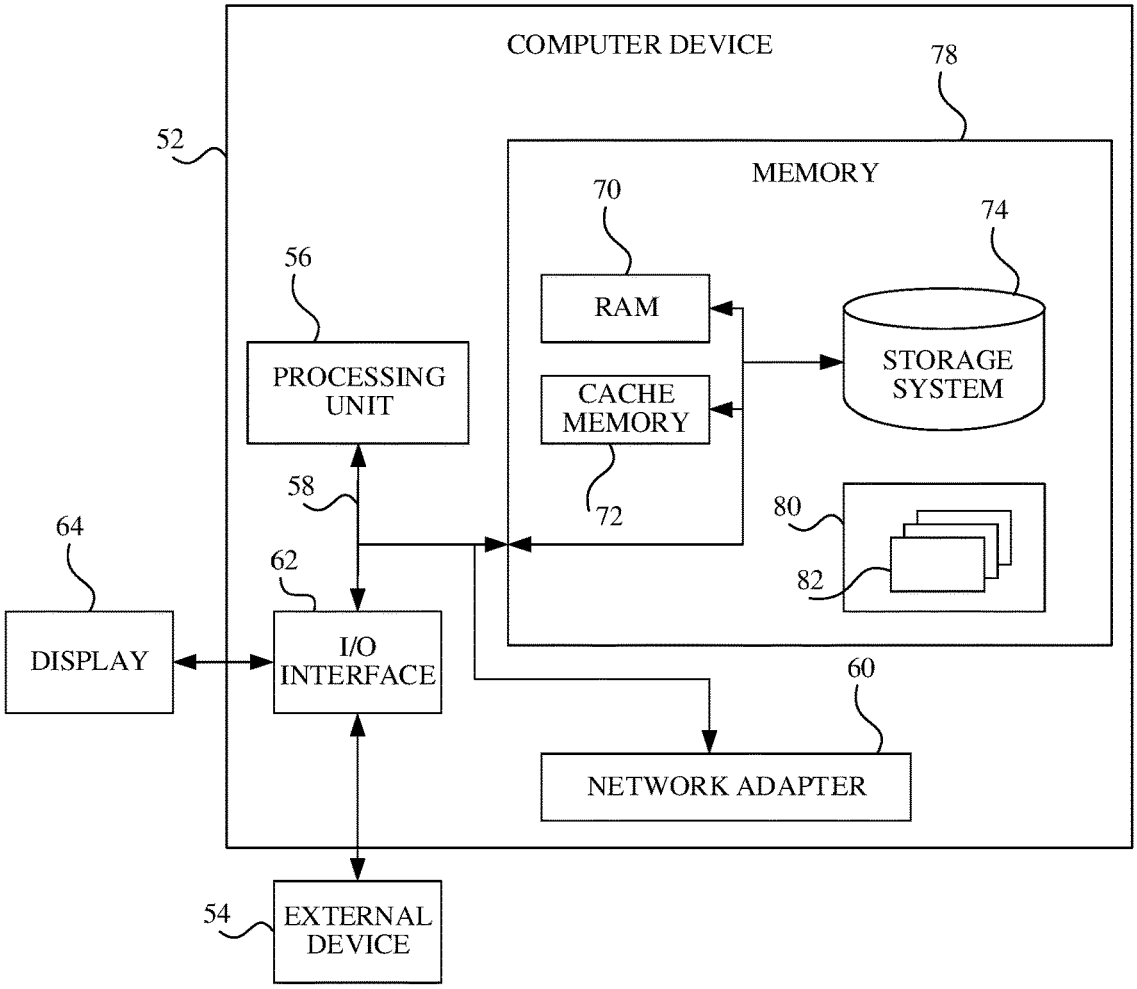
FIG. 4 is a structure diagram of an embodiment of computer device according to the application.

FIG. 4 is a structure diagram of an embodiment of computer device according to the application. The computer device may include a memory, a processor, and a computer program which is stored on the memory and capable of running on the processor. When executing the computer program, the processor may implement the text-based speech synthesis method provided in the application.

The computer device may be a server, for example, a cloud server. Or the computer device may also be electronic equipment, for example, a smartphone, a smart watch, a Personal Computer (PC), a laptop, or a tablet. The embodiment does not limit the specific form of the computer device mentioned above.

FIG. 4 shows a block diagram of exemplary computer device 52 suitable for realizing the embodiments of the application. The computer device 52 shown in FIG. 4 is only an example and should not form any limit to the functions and application range of the embodiments of the application.

As shown in FIG. 4, the computer device 52 is represented in form of a universal computing device. Components of the computer device 52 may include, but is not limited to, one or more processors or processing units 56, a system memory 78, and a bus 58 connecting different system components (including the system memory 78 and the processing unit 56).

The bus 58 represents one or more of several types of bus structures, including a memory bus or memory controller, a peripheral bus, a graphics acceleration port, a processor, or a local bus that uses any of several bus structures. For example, these architectures include, but not limited to, an Industry Standard Architecture (ISA) bus, a Micro Channel Architecture (MAC) bus, an ISA bus, a Video Electronics Standards Association (VESA) local bus, and a Peripheral Component Interconnection (PCI) bus.

The computer device 52 typically includes a variety of computer system readable media. These media may be any available media that can be accessed by the computer device 52, including transitory and non-transitory media, removable and non-removable media.

The system memory 78 may include a computer system readable medium in the form of transitory memory, such as a Random Access Memory (RAM) 70 and/or a cache memory 72. The computer device 52 may further include removable/immovable transitory/non-transitory computer system storage media. As an example only, the storage system 74 may be used to read and write immovable non-transitory magnetic media (not shown in FIG. 4 and often referred to as a "hard drive"). Although not shown in FIG. 4, a disk drive can be provided for reading and writing removable non-transitory disks (such as a "floppy disk") and a compact disc drive provided for reading and writing removable non-transitory compact discs (such as a Compact Disc Read Only Memory (CD-ROM), a Digital Video Disc Read Only Memory (DVD-ROM) or other optical media). In these cases, each driver may be connected with the bus 58 through one or more data medium interfaces. The memory 78 may include at least one program product having a group of (for example, at least one) program modules configured to perform the functions of the embodiments of the application.

A program/utility 80 with a group of (at least one) program modules 82 may be stored in the memory 78. Such a program module 82 includes, but not limited to, an operating system, one or more application programs, another program module and program data, and each of these examples or a certain combination may include implementation of a network environment. The program module 82 normally performs the functions and/or methods in the embodiments described in the application.

The computer device 52 may also communicate with one or more external devices 54 (for example, a keyboard, a pointing device and a display 64), and may also communicate with one or more devices through which a user may interact with the computer device 52 and/or communicate with any device (for example, a network card and a modem) through which the computer device 52 may communicate with one or more other computing devices. Such communication may be implemented through an Input/Output (I/O) interface 62. Moreover, the computer device 52 may also communicate with one or more networks (for example, a Local Area Network (LAN) and a Wide Area Network (WAN) and/or public network, for example, the Internet) through a network adapter 60. As shown in FIG. 4, the network adapter 60 communicates with the other modules of the computer device 52 through the bus 58. It is to be understood that, although not shown in FIG. 4, other hardware and/or software modules may be used in combination with the computer device 52, including, but not limited to, a microcode, a device driver, a redundant processing unit, an external disk drive array, a Redundant Array of Independent Disks (RAID) system, a magnetic tape drive, a data backup storage system, and the like.

The processing unit 56 performs various functional applications and data processing by running the program stored in the system memory 78, such as the speech synthesis method provided in the embodiments of the application.

Embodiments of the application further provide a non-transitory computer-readable storage medium, in which a computer program is stored. When executed by the processor, the computer program may implement the text-based speech synthesis method provided in the embodiments of the application.

The non-transitory computer-readable storage medium may be any combination of one or more computer-readable media. The computer-readable medium may be a computer-readable signal medium or a computer-readable storage medium. The computer-readable storage medium may be, but is not limited to, for example, an electrical, magnetic, optical, electromagnetic, infrared or semiconductor system, device or apparatus or any combination thereof. More specific examples (non-exhaustive list) of the computer-readable storage medium include an electrical connector with one or more wires, a portable computer disk, a hard disk, a RAM, a ROM, an Erasable Programmable ROM (EPROM) or a flash memory, an optical fiber, a portable CD-ROM, an optical storage device, a magnetic storage device, or any proper combination thereof. In the application, the computer-readable storage medium may be any tangible medium including or storing a program that may be used by or in combination with an instruction execution system, device, or apparatus.

The computer-readable signal medium may include a data signal in a baseband or propagated as part of a carrier, a computer-readable program code being born therein. A plurality of forms may be adopted for the propagated data signal, including, but not limited to, an electromagnetic signal, an optical signal, or any proper combination. The computer-readable signal medium may also be any computer-readable medium except the computer-readable storage medium, and the computer readable medium may send, propagate or transmit a program configured to be used by or in combination with an instruction execution system, device or apparatus.

The program code in the computer-readable medium may be transmitted with any proper medium, including, but not limited to, radio, an electrical cable, Radio Frequency (RF), etc. or any proper combination.

The computer program code configured to execute the operation of the application may be edited by use of one or more program design languages or a combination thereof, and the program design language includes an object-oriented program design language such as Java, Smalltalk, and C++ and further includes a conventional procedural program design language such as a "C" language or a similar program design language. The program code may be completely executed in a computer of a user, executed partially in a computer of a user, executed as an independent software package, executed partially in the computer of the user and partially in a remote computer, or executed completely in the remote computer or a server. Under the condition that the remote computer is involved, the remote computer may be concatenated to the computer of the user through any type of network including a LAN or a WAN, or, may be concatenated to an external computer (for example, concatenated by an Internet service provider through the Internet).

In the descriptions of the specification, the descriptions made with reference to the terms "an embodiment", "some embodiments", "example", "specific example", "some examples" or the like refer to that specific features, structures, materials, or characteristics described in combination with the embodiment or the example are included in at least one embodiment or example of the application. In the specification, these terms are not always schematically expressed for the same embodiment or example. Moreover, the specific described features, structures, materials, or characteristics may be combined in a proper manner in any one or more embodiments or examples. In addition, those of ordinary skill in the art may integrate and combine different embodiments or examples described in the specification and features of different embodiments or examples without conflicts.

In addition, the terms "first" and "second" are only adopted for description and should not be understood to indicate or imply relative importance or implicitly indicate the number of indicated technical features. Therefore, a feature defined by "first" and "second" may explicitly or implicitly indicate inclusion of at least one such feature. In the description of the application, "multiple" means at least two, for example, two and three, unless otherwise limited definitely and specifically.

Any process or method in the flowcharts or described herein in another manner may be understood to represent a module, segment, or part including codes of one or more executable instructions configured to realize customized logic functions or steps of the process and moreover, the scope of the preferred implementation mode of the application includes other implementation, not in a sequence shown or discussed herein, including execution of the functions basically simultaneously or in an opposite sequence according to the involved functions. This should be understood by those of ordinary skill in the art of the embodiments of the application.

For example, term "if" used here may be explained as "while" or "when" or "responsive to determining" or "responsive to detecting", which depends on the context. Similarly, based on the context, phrase "if determining" or "if detecting (stated condition or event)" may be explained as "when determining" or "responsive to determining" or "when detecting (stated condition or event)" or "responsive to detecting (stated condition or event)".

It is to be noted that the terminal referred to in the embodiments of the application may include, but not limited to, a Personal Computer (PC), a Personal Digital Assistant (PDA), a wireless handheld device, a tablet computer, a mobile phone, a MP3 player, and a MP4 player.

In some embodiments of the application, it is to be understood that the disclosed system, device and method may be implemented in another manner. For example, the device embodiment described above is only schematic, and for example, division of the units is only logic function division, and other division manners may be adopted during practical implementation. For example, multiple units or components may be combined or integrated into another system, or some characteristics may be neglected or not executed. In addition, coupling or direct coupling or communication connection between each displayed or discussed component may be indirect coupling or communication connection, implemented through some interfaces, of the device or the units, and may be electrical and mechanical or adopt other forms.

In addition, each functional unit in each embodiment of the application may be integrated into a processing unit, each unit may also physically exist independently, and two or more than two units may also be integrated into a unit. The integrated unit may be realized in form of hardware or in form of hardware plus software function unit.

The integrated unit realized in form of a software functional unit may be stored in a computer-readable storage medium. The software functional unit is stored in a storage medium and includes some instructions to enable a computer device (which may be a personal computer, a server, or a network device, etc.) or a processor to execute a part of steps of the method described in each embodiment of the application. The storage medium mentioned above includes: various media capable of storing program codes such as a USB flash disk, a mobile hard disk, a ROM, a RAM, a magnetic disk, or an optical disk.

The above are only some embodiments of the application and not intended to limit the application. Any modifications, equivalent replacements, improvements, and the like made within the spirit and principle of the application shall fall within the scope of protection of the disclosure.

What is claimed is:

1. A text-based speech synthesis method, comprising:

obtaining target text to be recognized;

discretely characterizing each character in the target text to generate a feature vector corresponding to each character;

obtaining a preset number of training text and matching speech corresponding to the training text;

discretely characterizing the training text to obtain a feature vector corresponding to each character in the training text;

inputting the feature vector corresponding to each character in the training text into a spectrum conversion model to be trained to obtain a Mel-spectrum output by the spectrum conversion model to be trained, wherein inputting the feature vector corresponding to each character in the training text into the spectrum conversion model to be trained to obtain the Mel-spectrum output by the spectrum conversion model to be trained comprises:

coding the training text through the spectrum conversion model to be trained to obtain a hidden state sequence corresponding to the training text, wherein the hidden state sequence comprises at least two hidden nodes and is obtained by mapping the feature vectors of each character in the training text one by one;

according to a weight of a hidden node corresponding to each character, weighting the hidden node to obtain a semantic vector corresponding to each character in the training text; and decoding the semantic vector corresponding to each character, and outputting the Mel-spectrum corresponding to each character;

when an error between the Mel-spectrum output by the spectrum conversion model to be trained and a Mel-spectrum corresponding to the matching speech is less than or equal to a preset threshold, obtaining the trained spectrum conversion model;

inputting the feature vector into a pre-trained spectrum conversion model to obtain a Mel-spectrum corresponding to each character in the target text output by the spectrum conversion model; and converting the Mel-spectrum into speech to obtain speech corresponding to the target text.

2. The method as claimed in claim 1, further comprising after inputting the feature vector corresponding to each character in the training text into the spectrum conversion model to be trained to obtain the Mel-spectrum output by the spectrum conversion model to be trained:

when the error between the Mel-spectrum output by the spectrum conversion model to be trained and the Mel-spectrum corresponding to the matching speech is greater than the preset threshold, updating the weight of each hidden node;

weighting the hidden node whose weight is updated to obtain a semantic vector corresponding to each character in the training text;

decoding the semantic vector corresponding to each character, and outputting the Mel-spectrum corresponding to each character; and when the error between the Mel-spectrum corresponding to each character and the Mel-spectrum corresponding to the matching speech is less than or equal to the preset threshold, stopping the updating the weight of each hidden node, and obtaining the trained spectrum conversion model.

3. The method as claimed in claim 1, wherein converting the Mel-spectrum into speech to obtain the speech corresponding to the target text comprises:

performing an inverse Fourier transform on the Mel-spectrum through a vocoder to convert the Mel-spectrum into a speech waveform signal in a time domain to obtain the speech.

4. The method as claimed in claim 1, wherein a number of characters in the training text corresponds to a number of hidden nodes.

5. A computer device, comprising:

a memory, a processor, and a computer program stored in the memory and capable of running on the processor, wherein the computer program, when executed by the processor, causes the processor to implement:

obtaining target text to be recognized;

discretely characterizing each character in the target text to generate a feature vector corresponding to each character;

obtaining a preset number of training text and matching speech corresponding to the training text;

discretely characterizing the training text to obtain a feature vector corresponding to each character in the training text;

inputting the feature vector corresponding to each character in the training text into a spectrum conversion model to be trained to obtain a Mel-spectrum output by the spectrum conversion model to be trained, wherein inputting the feature vector corresponding to each character in the training text into the spectrum conversion model to be trained to obtain the Mel-spectrum output by the spectrum conversion model to be trained comprises:

coding the training text through the spectrum conversion model to be trained to obtain a hidden state sequence corresponding to the training text, wherein the hidden state sequence comprises at least two hidden nodes and is obtained by mapping the feature vectors of each character in the training text one by one;

according to a weight of a hidden node corresponding to each character, weighting the hidden node to obtain a semantic vector corresponding to each character in the training text; and decoding the semantic vector corresponding to each character, and outputting the Mel-spectrum corresponding to each character;

when an error between the Mel-spectrum output by the spectrum conversion model to be trained and a Mel-spectrum corresponding to the matching speech is less than or equal to a preset threshold, obtaining the trained spectrum conversion model;

inputting the feature vector into a pre-trained spectrum conversion model to obtain a Mel-spectrum corresponding to each character in the target text output by the spectrum conversion model; and converting the Mel-spectrum into speech to obtain speech corresponding to the target text.

6. The computer device as claimed in claim 5, wherein the computer program, when executed by the processor, further causes the processor to implement: after inputting the feature vector corresponding to each character in the training text into the spectrum conversion model to be trained to obtain the Mel-spectrum output by the spectrum conversion model to be trained:

when the error between the Mel-spectrum output by the spectrum conversion model to be trained and the Mel-spectrum corresponding to the matching speech is greater than the preset threshold, updating the weight of each hidden node;

weighting the hidden node whose weight is updated to obtain a semantic vector corresponding to each character in the training text;

decoding the semantic vector corresponding to each character, and outputting the Mel-spectrum corresponding to each character; and when the error between the Mel-spectrum corresponding to each character and the Mel-spectrum corresponding to the matching speech is less than or equal to the preset threshold, stopping the updating the weight of each hidden node, and obtaining the trained spectrum conversion model.

7. The computer device as claimed in claim 5, wherein to implement converting the Mel-spectrum into speech to obtain the speech corresponding to the target text, the computer program, when executed by the processor, causes the processor to implement:

performing an inverse Fourier transform on the Mel-spectrum through a vocoder to convert the Mel-spectrum into a speech waveform signal in a time domain to obtain the speech.

8. The computer device as claimed in claim 5, wherein a number of characters in the training text corresponds to a number of hidden nodes.

9. A non-transitory computer-readable storage medium that stores a computer program, wherein the computer program, when executed by a processor, causes the processor to implement:

obtaining target text to be recognized;

discretely characterizing each character in the target text to generate a feature vector corresponding to each character;

obtaining a preset number of training text and matching speech corresponding to the training text;

discretely characterizing the training text to obtain a feature vector corresponding to each character in the training text;

inputting the feature vector corresponding to each character in the training text into a spectrum conversion model to be trained to obtain a Mel-spectrum output by the spectrum conversion model to be trained, wherein inputting the feature vector corresponding to each character in the training text into the spectrum conversion model to be trained to obtain the Mel-spectrum output by the spectrum conversion model to be trained comprises:

coding the training text through the spectrum conversion model to be trained to obtain a hidden state sequence corresponding to the training text, wherein the hidden state sequence comprises at least two hidden nodes and is obtained by mapping the feature vectors of each character in the training text one by one;

according to a weight of a hidden node corresponding to each character, weighting the hidden node to obtain a semantic vector corresponding to each character in the training text; and decoding the semantic vector corresponding to each character, and outputting the Mel-spectrum corresponding to each character;

when an error between the Mel-spectrum output by the spectrum conversion model to be trained and a Mel-spectrum corresponding to the matching speech is less than or equal to a preset threshold, obtaining the trained spectrum conversion model;

inputting the feature vector into a pre-trained spectrum conversion model to obtain a Mel-spectrum corresponding to each character in the target text output by the spectrum conversion model; and converting the Mel-spectrum into speech to obtain speech corresponding to the target text.

10. The non-transitory computer-readable storage medium as claimed in claim 9, wherein the computer program, when executed by the processor, further causes the processor to implement: after inputting the feature vector corresponding to each character in the training text into the spectrum conversion model to be trained to obtain the Mel-spectrum output by the spectrum conversion model to be trained:

when the error between the Mel-spectrum output by the spectrum conversion model to be trained and the Mel-spectrum corresponding to the matching speech is greater than the preset threshold, updating the weight of each hidden node;

weighting the hidden node whose weight is updated to obtain a semantic vector corresponding to each character in the training text;

decoding the semantic vector corresponding to each character, and outputting the Mel-spectrum corresponding to each character; and when the error between the Mel-spectrum corresponding to each character and the Mel-spectrum corresponding to the matching speech is less than or equal to the preset threshold, stopping the updating the weight of each hidden node, and obtaining the trained spectrum conversion model.

11. The non-transitory computer-readable storage medium as claimed in claim 9, wherein to implement converting the Mel-spectrum into speech to obtain the speech corresponding to the target text, the computer program, when executed by the processor, causes the processor to implement:

performing an inverse Fourier transform on the Mel-spectrum through a vocoder to convert the Mel-spectrum into a speech waveform signal in a time domain to obtain the speech.

12. The non-transitory computer-readable storage medium as claimed in claim 9, wherein a number of characters in the training text corresponds to a number of hidden nodes.

* * * * *